United States Patent [19]

Banks et al.

[11] Patent Number: 4,896,794

[45] Date of Patent: Jan. 30, 1990

[54] METHOD FOR PREPRESSURIZING DISPENSING CONTAINER AND FOR FILLING PRESSURIZED CONTAINER WITH FLOWABLE PRODUCT

[75] Inventors: Gordon L. Banks, Antwerp; Michael Moran, Kapellen, both of Belgium; Gerhard Obrist, Kaiseraugst, Switzerland

[73] Assignee: Enviro-Spray Systems, Inc., Hoboken, N.J.

[21] Appl. No.: 303,030

[22] Filed: Jan. 27, 1989

Related U.S. Application Data

[63] Continuation of Ser. No. 96,165, Sep. 11, 1987, abandoned.

[51] Int. Cl.[4] ..... B65D 83/14

[52] U.S. Cl. ..... 222/1; 222/386.5; 141/3; 141/20; 141/27

[58] Field of Search ..... 222/1, 95, 206, 214, 222/215, 105, 394, 399; 141/2, 3, 18, 20, 25, 26, 27; 53/432, 467, 470, 474

[56] References Cited

U.S. PATENT DOCUMENTS

| | | | |
|---|---|---|---|
| 194,597 | 8/1977 | Hearle | 222/399 |
| 3,225,967 | 12/1965 | Heimgartner | 222/206 X |
| 3,298,575 | 1/1967 | Larsen | 222/399 |
| 3,718,236 | 2/1973 | Reyner et al. | 222/386.5 |
| 3,949,911 | 4/1976 | Morane | 222/386.5 |
| 4,360,131 | 11/1982 | Reyner | 222/386.6 |
| 4,376,500 | 3/1983 | Banks et al. | 222/386.5 |
| 4,478,044 | 10/1984 | Magid | 60/721 |
| 4,491,250 | 1/1985 | Liebermann | 222/399 X |
| 4,513,884 | 4/1985 | Magid | 222/94 |
| 4,621,483 | 11/1986 | Magid | 53/455 |
| 4,646,946 | 3/1987 | Reyner | 222/399 X |
| 4,679,706 | 7/1987 | Magid et al. | 222/399 X |

*Primary Examiner*—Kevin P. Shaver
*Attorney, Agent, or Firm*—Kenyon & Kenyon

[57] ABSTRACT

A pressurization pouch having a pressurization system therein activated by the application of a vacuum underpressure to the outside surfaces of the pouch is inserted into a dispensing container through an opening in a lid portion of the container. Upon the sealing of the container by the attachment of a valve member to the container lid at the opening thereof, a vacuum generator is coupled to the valve member to generate negative pressure inside the dispensing container, thereby causing the pouch to expand under the pressure of a predetermined amount of air disposed therein. Upon that initial expansion, the pressurization pouch is further inflated owing to the action of the pressurization system. Upon complete inflation of the pressurization pouch, the pouch forms a liner in the dispensing container. A flowable product is then injected into the dispensing container through the valve member. The pouch comprises a pair of compartments releasably sealed and separated from one another by a seam having a sharp point formed by a pair of straight-line seam segments joining one another at an acute angle.

36 Claims, 2 Drawing Sheets

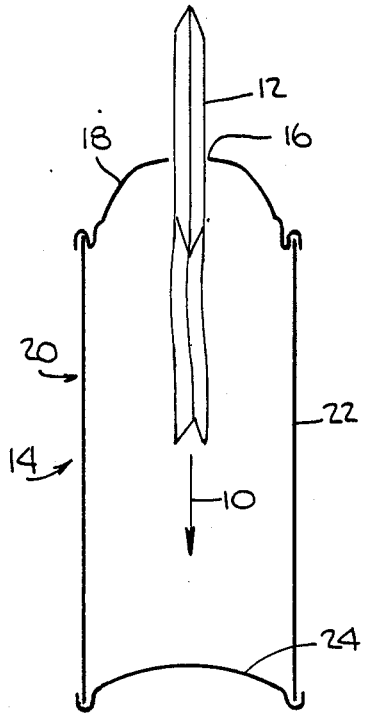
Fig. 1.
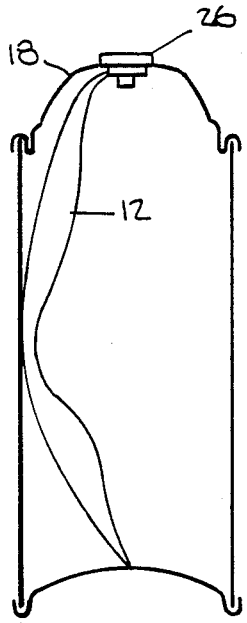
Fig. 2.
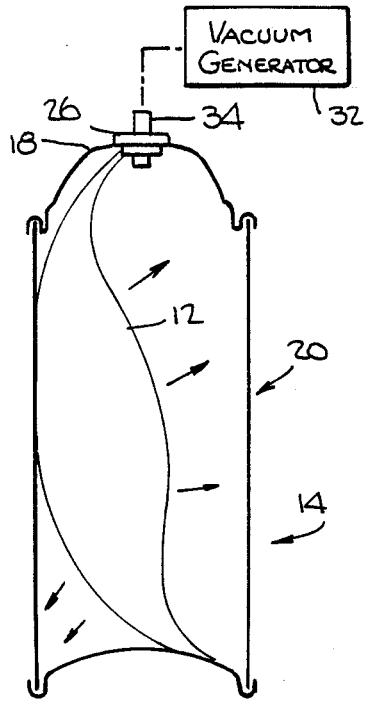
Fig. 3.
Fig. 4.
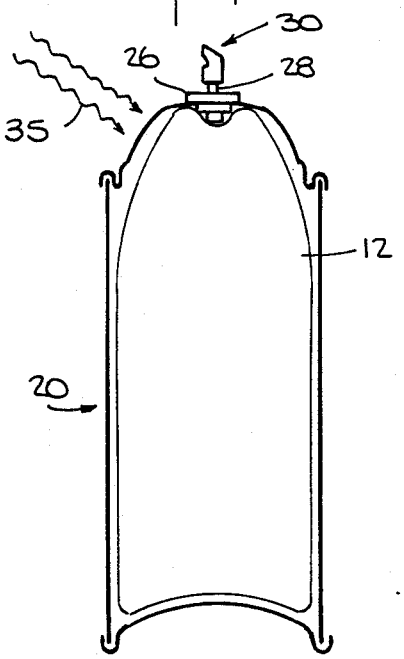
Fig. 5.
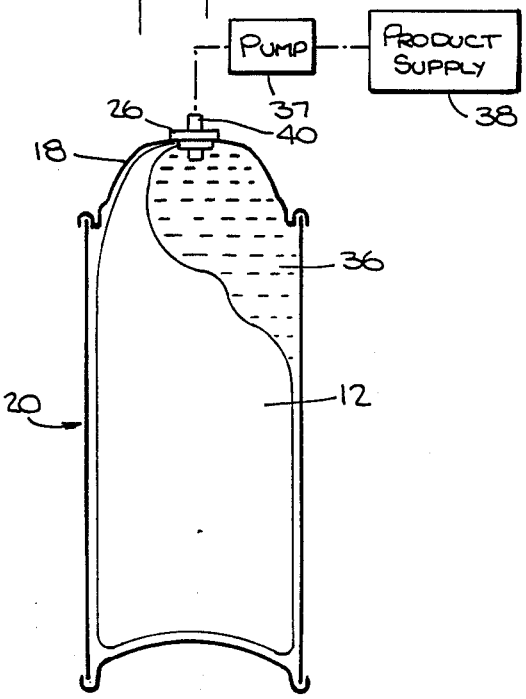

METHOD FOR PREPRESSURIZING DISPENSING CONTAINER AND FOR FILLING PRESSURIZED CONTAINER WITH FLOWABLE PRODUCT

This application is a continuation of application Ser. No. 096,165, filed 9/11/87, now abandoned.

BACKGROUND OF THE INVENTION

This invention relates to a method for prepressurizing a dispensing container and for filling a pressurized container with flowable product.

It is well known to dispense flowable products from a container such as an aerosal can by internal pressure that forces the product out through a nozzle when a valve is manually actuated. In a particularly desirable pressure generating system, a confined chemical reaction causes gas to be produced within the dispensing container without the reagents coming into contact with the product to be dispensed and without the release of the reagents or the gas to the atmosphere. In one such pressure generating system, as disclosed in U.S. Pat. Nos. 4,360,131 to Reyner, 4,376,500 to Banks et al. and 4,478,044 to Magid, different chemical reactants such as citric acid and sodium bicarbonate react with one another to form a gas such as carbond dioxide to expand an inflatable pouch.

U.S. Pat. No. 4,478,044 discloses an inflatable pouch for use in a dispensing container to provide pressure as the result of a repeated series of chemical reactions that release gas within the pouch each time a certain volume of product is dispensed through an outlet valve on the container. In a particular embodiment of the inflatable pouch, a pair of outer walls are permanently sealed around their peripheries to one another. The pouch contains a burstable bag holding a predetermined quantity of a first chemical reagent in liquid form. The pouch also contains a partly hydrolyzed polyvinyl alcohol ("PVA") bag holding a second chemical reagent preferably in the form of a powder. Immediately prior to the insertion of the pouch into a container through an open end thereof, the burstable bag is ruptured. Upon the release of the liquid reagent into contact with the PVA packet, the material of that packet dissolves and allows the powdered chemical reagent to come into contact with the liquid reagent, whereby a gas is generated to expand the pouch. This initial expansion commences only upon a delay equal to the time required for the water or other solvent to dissolve the PVA packet. During the delay, the container is filled with a flowable product and is sealed by a cap or lid containing a valve. Upon dispensing of a portion of the product through the valve, the pouch expands under the pressure generated by the initial gas generation. This pouch expansion causes the separation of a releasable seal between a base sheet and a cover sheet disposed inside the pouch together with the burstable bag and the PVA packet, the separating of the seal serving to release further quantities of one of the reagents from a series of pockets provided in the base sheet. The pockets are opened in seriatum as greater and greater amounts of product are dispensed from the container.

Pouches such as those disclosed in U.S. Pat. No. 4,478,044 are useful insofar as they may be shipped independently of the dispensing containers. However, the method of filling a can with a flowable consumer product, inserting an expandable pouch into the can and then crimping a cap with a valve on the can to seal it has several disadvantages. In particular, during the sealing of the can, air becomes trapped in the can and can interfere with the product and the dispensing process. Moreover, pouch shelf life is limited by the longevity and integrity of the seals insofar as the pouches cannot be used until the time the cans are to be filled with product. A further disadvantage is that the pouches must be inserted into the cans at the same production site at which the cans are filled with product, which requires that each product packaging facility must be equipped with on-site pouch insertion machinery.

OBJECTS OF THE INVENTION

An object of the present invention is to provide a method for prepressurizing a dispensing container.

Another, more particular, object of the present invention is to provide such a method, using an expandable pouch, in which prepackaged reagents are not required.

Another, concomitant, specific object of the present invention is to provide an improved expandable pouch for use in such a method, wherein production costs of the pouch are reduced.

Another object of the present invention is to provide an improved method for packaging a pressure generating system and a flowable product in dispensing containers.

Another particular object of the present invention is to provide such a packaging method in which volatile, toxic and oxygen sensitive products can be loaded into dispensing containers with a minimization of ambient exposure.

A specific object of the present invention is to provide such a packaging method in which an expandable pouch may be stored in an expanded state for an indefinite period of time in a can prior to filling of the can with product.

A further particular object of the present invention is to provide such a packaging method in which filling line space requirements are reduced and the need for expensive pouch insertion machinery at the filling sites eliminated.

An even more particular object of the present invention is to provide such a packaging method in which expandable pouches may be inserted into cans at a central location and the pressurized containers sent to filling sites.

Yet another particular object of the present invention is to provide a packaging method in which dispensing containers emptied of product may be refilled with product without exposing the insides of the containers to ambient conditions.

Yet another particular object of the present invention is to provide such a packaging method in which aseptic packaging conditions are facilitated.

SUMMARY OF THE INVENTION

Generally, a method for prepressurizing a product dispensing container comprises, in accordance with the present invention, the steps of (a) providing a pouch having a pressurization system for generating a gas to expand the pouch and produce a predetermined pressure therein, the pouch further having activation means for activating the pressurization system, the activation means being itself activated by the application of a partial vacuum to an outer side of the pouch, (b) inserting the pouch into the container, (c) closing the container, and (d) generating at least a partial vacuum in the container to activate the activation means and expand the pouch under pressure from the gas.

More particularly, a method for prepressurizing a product dispensing container comprises, in accordance with the present invention, the step of providing a pouch having a first compartment containing a first chemical reactant and a second compartment having a second chemical reactant, the pouch being provided with a releasable seal for releasably sealing the first compartment and the second compartment and for separating the first compartment and the second compartment from one another to prevent mixing of the first chemical reactant and the second chemical reactant. At least a portion of the pouch contains a predetermined quantity of a first gas which may be entrapped air. In subsequent steps pursuant to the invention, the pouch is inserted into the container, the container is closed, and at least a partial vacuum is generated in the container to release the releasable seal and expand the pouch under pressure from the entrapped gas, thereby enabling mixing of the first chemical reactant and the second chemical reactant to generate a predetermined quantity of a second gas for further expansion of the pouch and pressurization thereof to a predetermined pressure.

Pursuant to another feature of the present invention, the step of closing the container comprises the step of attaching to the container a cap having an opening, a valve being mounted to the cap in the opening. The step of generating a vacuum then comprises the steps of connecting a vacuum source to the cap and drawing air from the container through the opening and the valve.

A packaging method in accordance with the present invention comprises the steps of (a) providing a sealed container having pressurized means therein, (b) injecting a flowable product into the container, and (c) collapsing the pressurized means through the introduction of the flowable product into the container, the step of collapsing taking place simultaneously with the step of injecting. Preferably, the container includes a cap having an opening in which a valve is mounted, the flowable product being injected through the opening and the valve. The pressurized means advantageously comprises a pressurized pouch.

Pursuant to another feature of the present invention, the inflatable or expandable pouch includes a pair of sheets of metalized sythetic resin material, the compartments taking the form of pockets formed between the sheets. The sheets are permanently sealed to one another along peripheries thereof and temporarily sealed to one another along a seam dividing the pockets from one another to form the releasable seal. The seam is advantageously provided along its length with a sharp turn for controlling the amount of stress necessary to release the seal.

In a prepressurizing method using an expandable pouch, in accordance with the present invention, prepackaged reagents are not required and production costs of the pouch are reduced. Moreover, in a method for packaging a pressure generating system and a flowable product in dispensing containers, in accordance with the present invention, volatile, toxic and oxygen sensitive products can be loaded into dispensing containers with a minimization of ambient exposure. Filling the prepressurized containers through the valve ensures that the product is not contaminated by entrapped air. Accordingly, there is little or no need to purge containers with inert or liquifiable gases.

It is to be noted that inasmuch as product is injected into the prepressurized containers from the tops of the cans and inasmuch as the expandable pressurizing pouches are already inflated at the time of product loading, the product is disposed in the containers in an optimum location for dispensing. Product cannot be entrapped under the pouch or in folds of the pouch and evacuation will be improved. Thus, less product need be placed into a dispensing can to guarantee dispensed product in an amount specified on a packaging label. The need for flow tubes in the dispensing containers will also be reduced or eliminated.

In a packaging method pursuant to the present invention, an expandable pouch may be stored in an expanded state for an indefinite period of time in a can prior to filling of the can with product. Moreover, pouches may be inserted into cans at a central location and the pressurized containers sent to filling sites. Concomitantly, filling line space requirements are reduced and the need for expensive pouch insertion machinery at the filling sites is eliminated.

Upon the sealing of a dispensing container and prior to the injection of product into the container through the outlet valve thereof in accordance with the present invention, the pouch and the container can be irradiated for purposes of sterilization. Sterilization is thereby accomplished without heating or irradiating the product and has the advantage of not requiring sterile pouch manufacturing and insertion facilities.

A further advantage of the method of the present invention is that a damaged or leaking pouch will not impair sterile packaging facilities.

An inflatable pouch in accordance with the instant invention is insertable into a dispensing container and is provided with a pressure generating system for generating a dispensing pressure in the container to force a flowable product through an outlet of the container during a dispensing process. Pursuant to special features of the instant invention, the pouch comprises a pair of walls permanently sealed to one another along edges to form an enclosure, the walls being temporarily sealed directly to one another along a releasable seam to subdivide the enclosure into at least two compartments. Preferably, the seam has a plurality of linear segments, at least two of the segments contiguous with one another extending at an acute angle with respect to one another. The pressure generating system comprises a first chemical reactant disposed in a first one of the compartments and a second chemical reactant disposed in another of the compartments.

Pursuant to a particular feature of the instant invention, the pouch has a first and a second longitudinal edge and a first and a second transverse edge, the seam including a first segment extending from the first longitudinal edge towards the second longitudinal edge and the first transverse edge, the seam further including a second segment extending from the second longitudinal edge towards the first longitudinal edge and the first transverse edge. The first and the second segment constitute the two segments extending at an acute angle relative to one another.

Pursuant to an alternative particular feature of the instant invention, the pouch has a first and a second longitudinal edge and a first and a second transverse edge, the seam including a first segment extending from the first transverse edge towards the second transverse edge in parallel to the first and the second longitudinal edge, the seam also including a second segment extending from the second transverse edge towards the first transverse edge in parallel to the first and the second longitudinal edge. A third segment contiguous with the first segment extends therefrom towards the second longitudinal edge and the second transverse edge, while a fourth segment contiguous with the second segment extends therefrom towards the second longitudinal edge and the first transverse edge. The third and the fourth segment constitutes the two segments extending at an acute angle relative to one another.

BRIEF DESCRIPTION OF THE DRAWING

FIG. 1 is a schematic longitudinal cross sectional view of a dispensing container, showing a folded pressurization pouch being inserted into the container through an opening in a lid portion thereof.

FIG. 2 is a cross sectional view similar to FIG. 1, showing the inserted pressurization pouch and a valve member attached to the container at the lid opening.

FIG. 3 is a cross sectional view similar to FIG. 2, showing a vacuum generator attached to the valve member and the pressurization pouch being pulled open by vacuum underpressure.

FIG. 4 is a cross sectional view similar to FIG. 2, showing the pressurization pouch in a completely inflated state and showing a pushbutton member attached to the valve member.

FIG. 5 is a cross sectional view similar to FIG. 2, showing a source of flowable product and a pump connected to the valve member and the pressurization pouch partially compressed by product injected into the container through the valve member and the lid opening.

DETAILED DESCRIPTION

Figure 6:
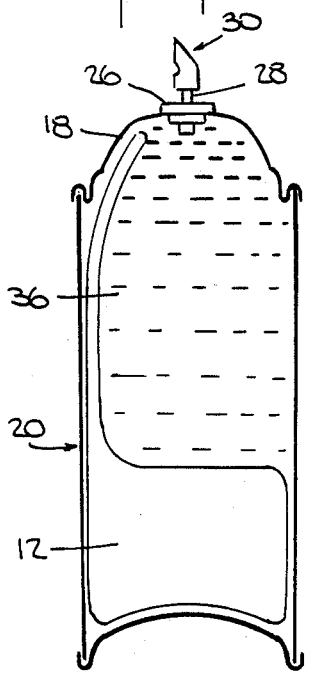
FIG. 6 is a cross sectional view similar to FIG. 4, showing the container filled with product and the pressurization pouch collapsed by injected product.

As indicated by an arrow 10 in FIG. 1, in a method in accordance with the present invention a pressurization pouch 12 is inserted in a folded configuration into a dispensing container 14 through an opening 16 in a lid portion 18 of the container. Lid portion 18 is crimped to a lower body portion 20 of dispensing container 14 along a rim thereof. Dispensing container 14 takes the form of a conventional metal aerosal can, body portion 20 including a cylindrical member 22 and a shallow cup-shaped member 24 crimped to cylindrical member along a lower rim thereof.

Upon the completed insertion of pressurization pouch 12 into dispensing container 14, a valve member 26 of conventional design is fastened to lid portion 18 at opening 16, as illustrated in FIG. 2. As depicted in FIGS. 4 and 6, valve member 26 is adapted to receive the plunger pin 28 of a conventional pushbutton member 30.

Pursuant to the instant invention, as described in detail hereinafter with reference to FIGS. 7–9, pressurization pouch 12 is provided with a pressure generating system activatable by the application of a vacuum underpressure to outside surface of the pressurization pouch. As depicted in FIG. 3, a vacuum generator 32 is coupled to valve member 26 via a connector element 34 having a hollow pin portion (not illustrated) of approximately the same diameter as plunger pin 28. Vacuum generator 32 is then operated to produce negative pressure of a predetermined magnitude inside dispensing container 14, the negative pressure being sufficient to cause activation of the pressure generating system of pressurization pouch 12. Generally, it is contemplated that a negative pressure of approximately ¼ bar will be sufficient to commence activation of the pressure generating system.

As shown in FIG. 3, upon the depressurization of dispensing container 14, pressurization pouch 12 begins to expand, initially because of the expansion of trapped air inside the pouch and subsequently because of the action of the pressure generating system. FIG. 4 shows the configuration of pressurization pouch 12 upon a total expansion thereof inside dispensing container 14. Pursuant to the invention, pressurization pouch 12 forms a liner within dispensing container 14, air being essentially entirely removed from the space between pressurization pouch 12 and inside surfaces of dispensing container 14.

Pursuant to a particular feature of the invention, the dispensing container and pouch of FIG. 4 can be subjected to a measured dose of electromagnetic radiation (represented in the drawing by wavy arrow 35) of a predetermined frequency and wavelength for purposes of sterilizing the container contents. The sterilized container and pouch can then be easily shipped to various product manufacturers or distributors located in different geographical regions.

At a product loading facility, a flowable product 36 (FIG. 5) such as shaving gel or mustard is injected into dispensing container 14 through opening 16 and valve member 26 under pressure generated by a pump 37 coupled at an upstream side to a product reservoir or supply 38 and at a downstream side to valve member 26 via a connector 40. FIG. 5 shows pressurization pouch 12 in a partially collapsed configuration during the injection process.

Upon the completion of the injection process, pressurization pouch 12 is in a substantially completely collapsed state, illustrated in FIG. 6. At that time dispensing container 14 may be provided with pushbutton member 30. That member may be transported with dispensing container 14 upon the inflation of expandable pressurization pouch 12, as indicated by FIG. 4.

During the use of dispensing container 14 by a consumer, product is dispensed from the container and pressurization pouch 12 expands from the fully collapsed state. Upon the dispensing of essentially the entire charge of product, dispensing container 14 may be returned to the manufacturer for refilling through opening 16 and valve member 26, as heretofore described with reference to FIG. 5.

Figure 7:
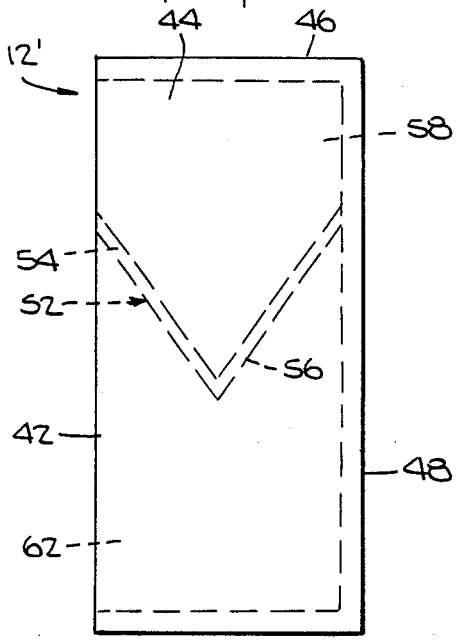
FIG. 7 is a side elevational view of a pressurization pouch pursuant to the instant invention.

As shown in FIG. 7, a pressurization pouch 12' in accordance with the instant invention advantageously comprises a single sheet of metalized synthetic resin material creased along a fold line 42 to form two overlapping walls 44 (only one visible in the drawing) permanently bonded or welded to one another along three edges 46, 48 and 50. Walls 44 are releasably sealed to one another along a V-shaped seam 52 comprising (a) a first linear segment 54 extending from fold line 42 towards longitudinal edge 48 and transverse edge 50 and (b) a second linear segment 56 extending from longitudinal edge 48 towards transverse edge 50 and fold line 42, which constitutes a another longitudinal edge of the pouch. Segments 54 and 56 are contiguous with one another and are oriented at an acute angle with respect to one another. The sharp point of V-shaped seam or seal 52 represents a point of high stress concentration to cause a predictable seal failure under vacuum activation. Seam 52 divides an enclosure defined by the edges of the pouch into a first compartment 58 holding a first chemical reactant 60 (see FIG. 8) such as citric acid and a second compartment 62 holding a second chemical reactant (FIG. 8) such as bicarbonate of soda.

Figure 8:
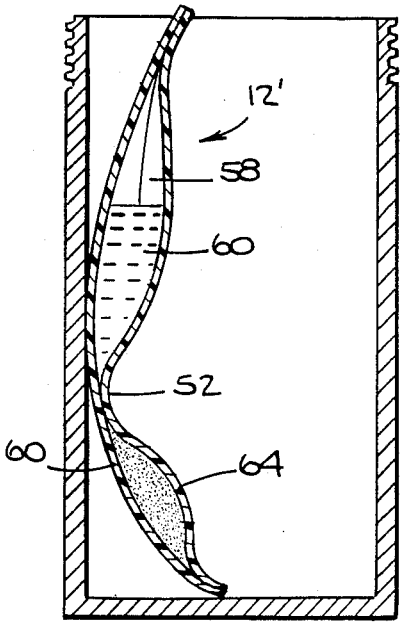
FIG. 8 is a longitudinal cross sectional view of the pressurization pouch of FIG. 7 in a lower portion of a dispensing container.

As depicted in FIG. 8, pouch 12' may be used for pressurizing a dispensing container including a lower portion 66 having at an upper end a screw thread for fastening a cap (not illustrated) to lower portion 66.

Figure 9:
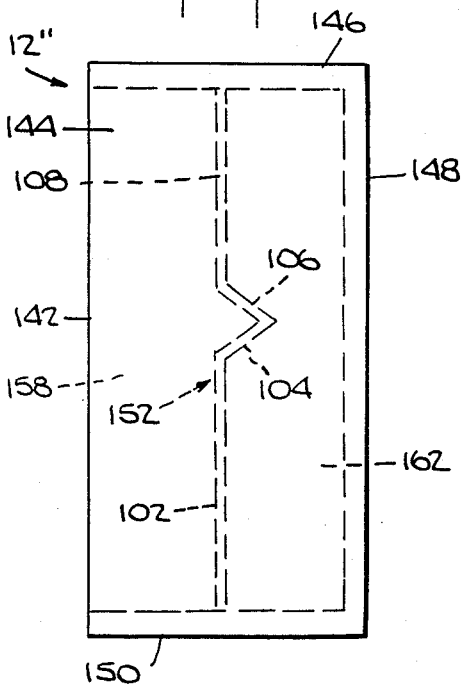
FIG. 9 is a side elevational view of another pressurization pouch in accordance with the present invention.

As shown in FIG. 9, in another pressurization pouch 12" pursuant to the present invention, a single sheet of metalized synthetic resin material creased along a fold line 142 to form two overlapping walls 144 (only one visible in the drawing) permanently bonded or welded to one another along three edges 146, 148 and 150. Walls 144 are releasably sealed to one another along a releasable seal 152 in the form of a seam having four linear or straight-line segments 102, 104, 106 and 108 connected end to end.

Seam segment 102 extends from transverse edge 150 towards transverse edge 146 in parallel to longitudinal edges 142 and 148. Seam segment 108 extends from transverse edge 146 towards transverse edge 150 in parallel to longitudinal edges 142 and 148. Seam segment 104 is contiguous with the first longitudinally extending segment 102 and extends therefrom towards longitudinal edge 148 and transverse edge 146, seam segment 106 is contiguous with the second longitudinally extending segment 108 and extends therefrom towards longitudinal edge 142 and transverse edge 150. Segments 104 and 106 are contiguous with one another and are oriented at an acute angle with respect to one another to form a sharp point 110 of seam 152. The sharp point represents a point of high stress concentration to cause a predictable seal failure under vacuum activation. Seam 52 divides an enclosure defined by the edges of the pouch into a first compartment 158 holding a first chemical reactant (compare FIG. 8) such as citric acid and a second compartment 162 holding a second chemical reactant such as bicarbonate of soda.

Pouch 12' (FIG. 7) is advantageous in that it provides a most predictable mixing of chemical reactants 60 and 64. Pressurization pouch 12" is advantageous in that it is easier to produce and brings the added benefit of having no preferred upper end, thereby eliminating failures caused by upside down insertion into dispensing container 14.

Although the invention has been described in terms of particular embodiments and applications, one or ordinary skill in the art, in light of this teaching, can generate additional embodiments and modifications without departing from the spirit of or exceeding the scope of the claimed invention. For example, valve member 26 has been specifically depicted to be a female valve but could alternatively take the form of male valve. It is only necessary that the valve member be of the two-way type. Moreover, although the invention has been described with particular reference to a dispensing container having a pressurization pouch, the invention is also applicable to a dispensing container having a movable piston and a pressurization system disposed on a side of the piston opposite the product and the valve member. Accordingly, it is to be understood that the drawings and descriptions herein are proferred by way of example to facilitate comprehension of the invention and should not be construed to limit the scope thereof.

What is claimed is:

1. A method for prepressurizing a product dispensing container, comprising the steps of:

providing a pouch having a first compartment containing a first chemical reactant and a second compartment having a second reactant, said pouch being provided with releasable sealing means for releasably sealing said first compartment and said second compartment and for separating said first compartment and said second compartment from one another to prevent mixing of said first chemical reactant and said second chemical reactant, at least a portion of said pouch containing a predetermined quantity of a first gas;

inserting said pouch into said container;

closing said container; and generating, before introducing any product into the container, at least a partial vacuum in said container to release said sealing means and expand said pouch under pressure from said gas, thereby enabling mixing of said first chemical reactant and said second chemical reactant to generate a predetermined quantity of a second gas for further expansion of said pouch and pressurization thereof to a predetermined pressure.

2. The method set forth in claim 1 wherein said step of closing said container comprises the step of attaching to said container a cap having an opening, a valve being mounted to said cap in said opening.

3. The method set forth in claim 2 wherein said step of generating a vacuum comprises the steps of connecting a vacuum source to said cap and drawing air from said container through said opening and said valve.

4. The method set forth in claim 3, further comprising the step of injecting a dispensable product into said container through said opening upon completion of said step of generating.

5. The method set forth in claim 4 wherein said step of injecting is performed after expansion of pouch and pressurization thereof to said predetermined pressure.

6. The method set forth in claim 5 wherein said pouch includes a pair of sheets of metalized sythetic resin material, said compartments taking the form of pockets formed between said sheets, said sheets being permanently sealed to one another along peripheries thereof and temporarily sealed to one another along a seam dividing said pockets from one another to form said sealing means.

7. The method set forth in claim 6 wherein said first chemical reactant and said second chemical reactant are sodium bicarbonate and citric acid.

8. The method set forth in claim 7 wherein said first gas and said second gas are carbon dioxide.

9. The method set forth in claim 7 wherein said first gas is air and said second gas is carbon dioxide.

10. The method set forth in claim 5 wherein said partial vacuum is at least ¼ bar.

11. The method set forth in claim 1, further comprising the step of injecting a dispensable product into said container upon completion of said step of generating.

12. The method set forth in claim 11 wherein said step of injecting comprises the step of pumping said product under pressure into said container.

13. The method set forth in claim 11 wherein said step of injecting is performed after expansion of pouch and pressurization thereof to said predetermined pressure.

14. The method set forth in claim 1 wherein said pouch includes a pair of sheets of metalized sythetic resin material, said compartments taking the form of pockets formed between said sheets, said sheets being permanently sealed to one another along peripheries thereof and temporarily sealed to one another along a seam dividing said pockets from one another to form said sealing means.

15. The method set forth in claim 1 wherein said first chemical reactant and said second chemical reactant are sodium bicarbonate and citric acid.

16. The method set forth in claim 15 wherein said first gas and said second gas are carbon dioxide.

17. The method set forth in claim 15 wherein said first gas is air and said second gas is carbon dioxide.

18. The method set forth in claim 1 wherein said partial vacuum is at least ¼ bar.

19. A method for prepressurizing a product dispensing container, comprising the steps of:

providing a sealed container holding a pouch having a first compartment containing a first chemical reactant and a second compartment having a second chemical reactant, said pouch being provided with releasable sealing means for releasably sealing said first compartment and said second compartment and for separating said first compartment and said second compartment from one another to prevent mixing of said first chemical reactant and said second chemical reactant, at least a portion of said pouch containing a predetermined quantity of a first gas;

before introducing any product into the container, generating at least a partial vacuum in said container to release said sealing means and expand said pouch under pressure from said gas, thereby enabling mixing of said first chemical reactant and said second chemical reactant to generate a predetermined quantity of a second gas for further expansion of said pouch and pressurization thereof to a predetermined pressure; and injecting dispensable product into said container upon completion of said step of generating.

20. The method set forth in claim 19 wherein said container has a cap provided with an opening, a valve being mounted to said cap in said opening, said step of generating comprising the steps of connecting a vacuum source to said cap and drawing air from said container through said opening said valve, said step of injecting comprising the step of injecting comprising the step of injecting said dispensable product through said opening and said valve.

21. A method for prepressurizing a product dispensing container, comprising the steps of:

providing a pouch having pressurization means for generating a gas to expand said pouch and produce a predetermined pressure therein, said pouch further having activation means for activating said pressurization means, said activation means being itself activated by the application of a partial vacuum to outer surfaces of said pouch;

inserting said pouch into said container;

closing said container; and generating at least a partial vacuum in said container to activate said activation means and expand said pouch under pressure from said gas before any product is introduced into the dispensing container.

22. The method set forth in claim 21 wherein said pouch has a first compartment and a second compartment, said pressurization means including a first chemical reactant disposed in said first compartment and a second chemical reactant disposed in said second compartment, said activation means comprising releasable sealing means provided in said pouch for releasably sealing said first compartment and said second compartment and for separating said first compartment and said second compartment from one another to prevent mixing of said first chemical reactant and said second chemical reactant, said activation means further comprising a predetermined quantity of a first gas disposed in said pouch.

23. The method set forth in claim 21 wherein said pouch comprises a pair of walls permanently sealed to one another along edges to form an enclosure, said walls being temporarily sealed directly to one another along a releasable seam to subdivide said enclosure into said first compartment and said second compartment, said seam constituting said releasable sealing means, said seam having a plurality of linear segments, at least two of said segments contiguous with one another extending at an acute angle with respect to one another.

24. The method set forth in claim 23 wherein said pouch has a first and a second longitudinal edge and a first and a second transverse edge, said seam including a first segment extending from said first longitudinal edge towards said second longitudinal edge and said first transverse edge, said seam further including a second segment extending from said second longitudinal edge towards said first longitudinal edge and said first transverse edge, said first and said second segment constituting said two of said segments.

25. The method set forth in claim 23 wherein the pouch has a first and a second longitudinal edge and a first and a second transverse edge, said seam including a first segment extending from said first transverse edge towards said second transverse edge in parallel to said first and said second longitudinal edge, said seam also including a second segment extending from said second transverse edge towards said first transverse edge in parallel to said first and said second longitudinal edge, said seam also including a third segment contiguous with said first segment and extending therefrom towards said second longitudinal edge and said second transverse edge, said seam further including a fourth segment contiguous with said second segment and extending therefrom towards said second longitudinal edge and said first transverse edge, said third and said fourth segment constituting said two of said segments.

26. A method for filling a dispensing container with a product, comprising the steps of:

providing a sealed container having a pressurized pouch therein;

injecting a flowable product into said container; and collapsing said pressurized pouch through the introduction of said flowable product into said container, said step of collapsing taking place simultaneously with said step of injecting.

27. The method set forth in claim 26 wherein said container includes a cap having an opening, a valve being mounted to said cap in said opening, said flowable product being injected through said opening and said valve.

28. A method for filling a dispensing container with a product, comprising the steps of:

providing a sealed container holding a pressurized pouch, said container including a cap having an opening, a valve being mounted to said cap in said opening; and injecting a flowable product into said container through said opening and said valve, and simultaneously collapsing said pouch;

said product being subsequently ejected by the expansion of said pressurized pouch when said valve is opened to atmosphere.

29. The method set forth in claim 28 wherein said step of injecting comprises the step of pumping said flowable product under pressure into said container.

30. An inflatable pouch insertable into a dispensing container, said pouch being provided with a pressure generating system for generating a dispensing pressure in said container to force a flowable product through an outlet of said container during a dispensing process, said pouch comprising a pair of walls permanently sealed to one another along edges to form an enclosure, said walls being temporarily sealed directly to one another along a releasable seam to subdivide said enclosure into at least two compartments, said seam being adapted to be released upon the application of a vacuum underpressure of a predetermined magnitude to external surfaces of the pouch, said pressure generating system comprising a first chemical reactant disposed in a first one of said compartments and a second chemical reactant disposed in another of said compartments, said pouch having a predetermined quantity of a gas disposed in said pouch.

31. An inflatable pouch insertable into a dispensing container, said pouch being provided with a pressure generating system for generating a dispensing pressure in said container to force a flowable product through an outlet of said container during a dispensing process, said pouch comprising a pair of walls permanently sealed to one another along edges to form an enclosure, said walls being temporarily sealed directly to one another along a releasable seam to subdivide said enclosure into at least two compartments, said seam having a plurality of linear segments, at least two of said segments contiguous with one another extending at an acute angle with respect to one another, said pressure generating system comprising a first chemical reactant disposed in a first one of said compartments and a second chemical reactant disposed in another of said compartments.

32. The inflatable pouch set forth in claim 31 wherein the pouch has a first and a second longitudinal edge and a first and a second transverse edge, said seam including a first segment extending from said first longitudinal edge towards said second longitudinal edge and said first transverse edge, said seam further including a second segment extending from said second longitudinal edge towards said first longitudinal edge and said first transverse edge, said first and said second segment constituting said two of said segments.

33. The inflatable pouch set forth in claim 31 wherein the pouch has a first and a second longitudinal edge and a first and a second transverse edge, said seam including a first segment extending from said first transverse edge towards said second transverse edge in parallel to said first and said second longitudinal edge, said seam also including a second segment extending from said second transverse edge towards said first transverse edge in parallel to said first and said second longitudinal edge, said seam also including a third segment contiguous with said first segment and extending therefrom towards said second longitudinal edge and said second transverse edge, said seam further including a fourth segment contiguous with said second segment and extending therefrom towards said second longitudinal edge and said first transverse edge, said third and said fourth segment constituting said two of said segments.

34. The inflatable pouch set forth in claim 31 wherein said pouch contains a predetermined amount of air for enabling a separation of said seam by application of a vacuum to external surfaces of said walls.

35. An inflatable pouch insertable into a dispensing container, comprising:

two wall portions permanently sealed to one another to form an enclosure space;

a releasable seal directly attaching said two walls and dividing said enclosure space into two regions, said pouch having pressurization means for generating a gas, disposed in said enclosure space, to expand said pouch and produce a predetermined pressure therein and means for releasing said releasable seal by the application of a partial vacuum of a predetermined magnitude to outer surfaces of said pouch, thereby activating said pressurization means in said enclosure space, said releasable seal being capable of withstanding a negative pressure applied to said pouch up to ¼ bar.

36. The pouch set forth in claim 35 wherein said pressurization means includes a first chemical reactant disposed in one of said two regions and a second chemical reactant disposed in the other of said two regions, said releasable seal pouch for releasable sealing and first compartment and said preventing a mixing of said first chemical reactant and said second chemical reactant, said means for releasing comprising a predetermined quantity of a first gas disposed in said pouch.

* * * * *

UNITED STATES PATENT AND TRADEMARK OFFICE

CERTIFICATE OF CORRECTION

PATENT NO. : 4,896,794

DATED : 30 January 1990

INVENTOR(S) : Gordon L. BANKS et al.

It is certified that error appears in the above-identified patent and that said Letters Patent is hereby corrected as shown below:

| Column | Line | Corrections |
|---|---|---|
| 3 | 47 | Change "sythetic" to --synthetic--. |
| 7 | 56 | Change "or" to --of--. |
| 8 | 47 | Change "sythetic" to --synthetic--. |
| 9 | 5 | Change "sythetic" to --synthetic--. |
| 9 | 51 | After "opening" insert --and--. |
| 9 | 52 | Delete "the step of injecting comprising". |
| 12 | 49-50 | Delete "pouch for releasable sealing and first compartment and said". |

Signed and Sealed this

Twenty-third Day of April, 1991

*Attest:*

*Attesting Officer*

HARRY F. MANBECK, JR.

*Commissioner of Patents and Trademarks*